US008632145B2

(12) United States Patent
Madigan et al.

(10) Patent No.: US 8,632,145 B2
(45) Date of Patent: Jan. 21, 2014

(54) METHOD AND APPARATUS FOR PRINTING USING A FACETTED DRUM

(75) Inventors: Conor Francis Madigan, San Francisco, CA (US); Eliyahu Vronsky, Los Altos, CA (US); Alexander Sou-Kang Ko, Santa Clara, CA (US); Robert B. Lowrance, Los Gatos, CA (US); Christopher Buchner, Sunnyvale, CA (US)

(73) Assignee: Kateeva, Inc., Menlo Park, CA (US)

( * ) Notice: Subject to any disclaimer, the term of this patent is extended or adjusted under 35 U.S.C. 154(b) by 0 days.

(21) Appl. No.: 13/175,826

(22) Filed: Jul. 2, 2011

(65) Prior Publication Data

US 2012/0001967 A1 Jan. 5, 2012

Related U.S. Application Data

(63) Continuation-in-part of application No. 12/954,910, filed on Nov. 29, 2010, now abandoned, and a continuation-in-part of application No. 12/139,404, filed on Jun. 13, 2008, now abandoned.

(60) Provisional application No. 61/473,646, filed on Apr. 8, 2011, provisional application No. 60/944,000, filed on Jun. 14, 2007.

(51) Int. Cl.
*B41J 29/38* (2006.01)

(52) U.S. Cl.
USPC ..... 347/6

(58) Field of Classification Search
None
See application file for complete search history.

(56) References Cited

U.S. PATENT DOCUMENTS

| | | | |
|---|---|---|---|
| 4,238,807 | A | 12/1980 | Bovio et al. |
| 4,751,531 | A | 6/1988 | Saito et al. |
| 5,041,161 | A | 8/1991 | Cooke et al. |
| 5,116,148 | A | 5/1992 | Ohara et al. |
| 5,155,502 | A | 10/1992 | Kimura et al. |
| 5,172,139 | A | 12/1992 | Sekiya et al. |
| 5,202,659 | A | 4/1993 | DeBonte et al. |

(Continued)

FOREIGN PATENT DOCUMENTS

| | | |
|---|---|---|
| EP | 1 626 103 | 2/2006 |
| JP | 06-122201 | 5/1994 |

(Continued)

OTHER PUBLICATIONS

Street et al., "Jet Printing of Active-Matrix TFT Backplanes for Displays and Sensors", *IS&T Archiving*, Dec. 2005, vol. 20, No. 5, 16 pages.

(Continued)

*Primary Examiner* — Laura Martin
*Assistant Examiner* — Tracey McMillion

(57) ABSTRACT

The disclosure generally relates to a method and apparatus for printing from a rotating source. In an exemplary embodiment, the disclosure relates to a facetted drum for simultaneously printing multiple pixels. The facetted drum includes a support structure and a plurality of printheads affixed to the support structure, each printhead having at least one microporous structure for receiving a first quantity of liquid ink having dissolved or suspended film material in a carrier fluid and dispensing a second quantity of ink material substantially free of the carrier fluid. The plurality of printheads are positioned proximal to a substrate to simultaneously print a plurality of spatially-discrete and image-resolved pixels on the substrate.

31 Claims, 7 Drawing Sheets

(56) References Cited

U.S. PATENT DOCUMENTS

| | | | | |
|---|---|---|---|---|
| 5,247,190 | A | 9/1993 | Friend et al. | |
| 5,405,710 | A | 4/1995 | Dodobalapur et al. | |
| 5,574,485 | A | 11/1996 | Anderson et al. | |
| 5,623,292 | A | 4/1997 | Shrivasta | |
| 5,703,436 | A | 12/1997 | Forrest et al. | |
| 5,707,745 | A | 1/1998 | Forrest et al. | |
| 5,731,828 | A | 3/1998 | Ishinaga et al. | |
| 5,781,210 | A | 7/1998 | Hirano et al. | |
| 5,801,721 | A | 9/1998 | Gandy et al. | |
| 5,834,893 | A | 11/1998 | Bulovic et al. | |
| 5,844,363 | A | 12/1998 | Gu et al. | |
| 5,865,860 | A | 2/1999 | Delnick | |
| 5,947,022 | A | 9/1999 | Freeman et al. | |
| 5,956,051 | A | 9/1999 | Davies et al. | |
| 6,013,982 | A | 1/2000 | Thompson et al. | |
| 6,065,825 | A | 5/2000 | Anagnostopoulos et al. | |
| 6,086,195 | A | 7/2000 | Bohorquez et al. | |
| 6,086,196 | A | 7/2000 | Ando et al. | |
| 6,086,679 | A | 7/2000 | Lee et al. | |
| 6,087,196 | A | 7/2000 | Sturm et al. | |
| 6,091,195 | A | 7/2000 | Forrest et al. | |
| 6,095,630 | A | 8/2000 | Horii et al. | |
| 6,097,147 | A | 8/2000 | Baldo et al. | |
| 6,189,989 | B1 | 2/2001 | Hirabayashi et al. | |
| 6,250,747 | B1 | 6/2001 | Hauck | |
| 6,257,706 | B1 | 7/2001 | Ahn | |
| 6,294,398 | B1 | 9/2001 | Kim et al. | |
| 6,303,238 | B1 | 10/2001 | Thompson et al. | |
| 6,312,083 | B1 | 11/2001 | Moore | |
| 6,326,224 | B1 | 12/2001 | Xu et al. | |
| 6,337,102 | B1 | 1/2002 | Forrest et al. | |
| 6,431,702 | B2 | 8/2002 | Ruhe | |
| 6,444,400 | B1 | 9/2002 | Cloots et al. | |
| 6,453,810 | B1 | 9/2002 | Rossmeisl et al. | |
| 6,460,972 | B1 | 10/2002 | Trauernicht et al. | |
| 6,468,819 | B1 | 10/2002 | Kim et al. | |
| 6,472,962 | B1 | 10/2002 | Guo et al. | |
| 6,498,802 | B1 | 12/2002 | Chu et al. | |
| 6,513,903 | B2 | 2/2003 | Sharma et al. | |
| 6,523,926 | B1 * | 2/2003 | Mitsuzawa et al. | 347/19 |
| 6,548,956 | B2 | 4/2003 | Forrest et al. | |
| 6,562,405 | B2 | 5/2003 | Eser et al. | |
| 6,576,134 | B1 | 6/2003 | Agner | |
| 6,586,763 | B2 | 7/2003 | Marks et al. | |
| 6,601,936 | B2 | 8/2003 | McDonald | |
| 6,666,548 | B1 * | 12/2003 | Sadasivan et al. | 347/77 |
| 6,811,896 | B2 | 11/2004 | Aziz et al. | |
| 6,824,262 | B2 | 11/2004 | Kubota et al. | |
| 6,861,800 | B2 | 3/2005 | Tyan et al. | |
| 6,896,346 | B2 | 5/2005 | Trauernicht et al. | |
| 6,911,671 | B2 | 6/2005 | Marcus et al. | |
| 6,917,159 | B2 | 7/2005 | Tyan et al. | |
| 6,982,005 | B2 | 1/2006 | Eser et al. | |
| 7,023,013 | B2 | 4/2006 | Ricks et al. | |
| 7,077,513 | B2 | 7/2006 | Kimura et al. | |
| 7,247,394 | B2 | 7/2007 | Hatwar et al. | |
| 7,374,984 | B2 | 5/2008 | Hoffman | |
| 7,377,616 | B2 | 5/2008 | Sakurai | |
| 7,404,862 | B2 | 7/2008 | Shtein et al. | |
| 7,406,761 | B2 | 8/2008 | Jafri et al. | |
| 7,410,240 | B2 | 8/2008 | Kadomatsu et al. | |
| 7,431,435 | B2 | 10/2008 | Lopez et al. | |
| 7,431,968 | B1 | 10/2008 | Shtein et al. | |
| 7,530,778 | B2 | 5/2009 | Yassour et al. | |
| 7,603,439 | B2 | 10/2009 | Yassour et al. | |
| 7,604,439 | B2 | 10/2009 | Yassour et al. | |
| 7,648,230 | B2 | 1/2010 | Kachi | |
| 7,677,690 | B2 | 3/2010 | Takatsuka | |
| 7,802,537 | B2 | 9/2010 | Kang et al. | |
| 7,857,121 | B2 | 12/2010 | Yassour | |
| 7,883,832 | B2 | 2/2011 | Colburn et al. | |
| 7,908,885 | B2 | 3/2011 | Devitt | |
| 8,128,753 | B2 | 3/2012 | Bulovic et al. | |
| 2001/0045973 | A1 * | 11/2001 | Sharma et al. | 347/54 |
| 2002/0008732 | A1 | 1/2002 | Moon et al. | |
| 2002/0191063 | A1 | 12/2002 | Gelbart et al. | |
| 2003/0230980 | A1 | 12/2003 | Forrest et al. | |
| 2004/0009304 | A1 | 1/2004 | Pichler | |
| 2004/0048000 | A1 | 3/2004 | Shtein et al. | |
| 2004/0048183 | A1 | 3/2004 | Teshima | |
| 2004/0056244 | A1 | 3/2004 | Marcus et al. | |
| 2004/0086631 | A1 | 5/2004 | Han | |
| 2004/0174116 | A1 | 9/2004 | Lu et al. | |
| 2004/0202794 | A1 | 10/2004 | Yoshida | |
| 2005/0190220 | A1 | 9/2005 | Lim et al. | |
| 2005/0255249 | A1 | 11/2005 | Schlatterbeck | |
| 2006/0012290 | A1 | 1/2006 | Kang | |
| 2006/0115585 | A1 | 6/2006 | Bulovic et al. | |
| 2007/0040877 | A1 | 2/2007 | Kachi | |
| 2007/0058010 | A1 | 3/2007 | Nagashima | |
| 2007/0098891 | A1 | 5/2007 | Tyan et al. | |
| 2007/0134512 | A1 | 6/2007 | Klubek et al. | |
| 2007/0286944 | A1 | 12/2007 | Yokoyama et al. | |
| 2008/0174235 | A1 | 7/2008 | Kim et al. | |
| 2008/0238310 | A1 | 10/2008 | Forrest et al. | |
| 2008/0299311 | A1 | 12/2008 | Shtein et al. | |
| 2008/0308037 | A1 | 12/2008 | Bulovic et al. | |
| 2008/0311289 | A1 | 12/2008 | Bulovic et al. | |
| 2008/0311296 | A1 | 12/2008 | Shtein et al. | |
| 2008/0311307 | A1 | 12/2008 | Bulovic et al. | |
| 2009/0031579 | A1 | 2/2009 | Piatt et al. | |
| 2009/0045739 | A1 | 2/2009 | Kho et al. | |
| 2009/0115706 | A1 | 5/2009 | Hwang et al. | |
| 2009/0167162 | A1 | 7/2009 | Liu et al. | |
| 2009/0220680 | A1 | 9/2009 | Winters | |
| 2010/0055810 | A1 | 3/2010 | Sung et al. | |
| 2010/0079513 | A1 | 4/2010 | Taira et al. | |
| 2010/0171780 | A1 | 7/2010 | Madigan et al. | |
| 2010/0188457 | A1 | 7/2010 | Madigan et al. | |
| 2010/0201749 | A1 | 8/2010 | Somekh et al. | |
| 2010/0310424 | A1 | 12/2010 | Rose et al. | |
| 2011/0008541 | A1 | 1/2011 | Madigan et al. | |
| 2011/0057171 | A1 | 3/2011 | Adamovich et al. | |
| 2011/0181644 | A1 | 7/2011 | Bulovic et al. | |
| 2011/0267390 | A1 | 11/2011 | Bulovic et al. | |
| 2011/0293818 | A1 | 12/2011 | Madigan et al. | |

FOREIGN PATENT DOCUMENTS

| | | |
|---|---|---|
| JP | 08-216401 | 8/1996 |
| JP | 09-248918 | 9/1997 |
| JP | 2002-069650 | 3/2002 |
| JP | 2005-286069 | 10/2005 |
| JP | 2006-123551 | 5/2006 |
| JP | 2006-150900 | 6/2006 |
| JP | 2007-076168 | 3/2007 |
| JP | 2007-095343 | 4/2007 |
| JP | 2007-299616 | 11/2007 |
| JP | 05-255630 | 10/2009 |
| KR | 100232852 | 12/1999 |
| KR | 10-2008-0060111 | 7/2007 |
| WO | WO 2005/090085 | 9/2005 |

OTHER PUBLICATIONS

Forrest, Stephen R., "The Path to Ubiquitous and Low-cost Organic Electronic Appliances on Plastic," *Nature*, Apr. 29, 2004, vol. 428, 8 pages.

Leblanc et al., "Micromachined Printheads for the Evaporative Patterning of Organic Materials and Metals," *Journal of Microelectromechanical Systems*, Apr. 2007, vol. 16, No. 2, 7 pp. 1-139.

Lindermann et al., "Thermal Bubble Jet Printhead with Integrated Nozzle Plate," *NIP20: International Conference on Digital Printing Technologies*, Oct. 2004, pp.834-839.

Chen, Jianglong, "Novel Patterning Techniques for Manufacturing Organic and Nanostructured Electronics," *M.S. Materials Science and Engineering*, Massachusetts Institute of Technology, 2003, pp. 1-206.

Chen, Jingkuang et al., "A High-Resolution Silicon Monolithic Nozzle Array for Inkjet Printing," *IEEE Transactions on Electron Devices*, vol. 44, No. 9, Sep. 1997, pp. 1401-1409.

(56) References Cited

OTHER PUBLICATIONS

Chen et al., "Evaporative Deposition of Molecular Organics in Ambient with a Molecular Jet Printer," *Digital Fabrication*, Sep. 2006, pp. 63-65.
Chen et al., "Ambient Environment Patterning of Organic Thin Films by a Second Generation Molecular Jet (MoJet) Printer," *Progress Report 2006-2007*, Oct. 2007, pp. 26-6-26-7.
International Search Report issued on Dec. 15, 2010 for PCT Application No. PCT/US10/020144.
International Search Report issued on Sep. 2, 2010 for PCT Application No. PCT/US10/033315.
International Search Report and Written Opinion issued on Mar. 24, 2011 for PCT Application No. PCT/US10/058145.
International Preliminary Report on Patentability issued on Dec. 17, 2009 for PCT Application No. PCT/US08/66975.
International Preliminary Report on Patentability issued on Dec. 7, 2009 for PCT Application No. PCT/US08/066991.
International Preliminary Report on Patentability issued on Dec. 17, 2009 for PCT Application No. PCT/US08/67002.
US Non-Final Office Action issued for U.S. Appl. No. 12/139,391, on Jun. 7, 2011.
US Non-Final Office Action issued for U.S. Appl. No. 12/139,404, on Jun. 24, 2011.
US Non-Final Office Action issued for U.S. Appl. No. 11/282,472, on Sep. 16, 2009.
US Final Office Action issued for U.S. Appl. No. 11/282,472, on Jan. 6, 2010.
US Non-Final Office Action issued for U.S. Appl. No. 11/282,472, on Nov. 18, 2010.
EP Examination Report dated Jul. 30, 2010 issued for EP Patent Application 08771068.7.
CN Office Action dated Oct. 12, 2010 issued for CN Patent Application 200880020197.8.
EP Examination Report dated Jul. 13, 2010 issued for EP Patent Application 08771094.3.
CN Office Action dated Dec. 17, 2010 issued for CN Patent Application 200880020151.6.
CN Office Action dated Jan. 12, 2011 issued for CN Patent Application 200880019990.6.
EP Examination Report dated Jul. 13, 2010 issued for EP Patent Application 08771084.4.
Chin, Byung Doo, "Effective Hole Transport Layer Structure for Top Emitting Devices Based on Laser Transfer Patterning," Journal of Physics D: Applied Physics, 2007, vol. 40, pp. 5541-5546.
Elwenspoek et al., "Silicon Micromachining," Aug. 2004, Cambridge University, Cambridge, U.K. ISBN 0521607671. [Abstract].
C. Ducso, et al. "Porous Silicon Bulk Micromachining for Thermally Isolated Membrane Formation," Sensors and Actuators A, 1997, vol. 60, pp. 235-239.
C. Tsamis, et al. "Thermal Properties of Suspended Porous Microhotplates for Sensor Applications," Sensor and Actuators B, 2003, vol. 95, pp. 78-82.
J. Lee, et al. "Differential Scanning Calorimeter Based on Suspended Membrane Single Crystal Silicon Microhotplate," Journal of Microelectromechanical Systems, Dec. 2008, vol. 17, No. 6, pp. 1513-1525.
J. C. Belmonte, et al. "High-temperature Low-power Performing Micromachined Suspended Micro-hotplate for Gas Sensing Applications<" Sensors and Actuators B, 2006, vol. 114, pp. 826-835.
G.S. Chung, "Fabrication and Characterization of Micro-heaters with Low-power Consumption using SOI membrane and Trench Structures," Sensors and Actuators A, 2004, vol. 112, pp. 55-60.
Geffroy et al., "Organic Light-emitting Diode (OLED) Technology: Material Devices and Display Technologies," Polymer International, Jun. 2006, vol. 55, pp. 572-582. (Abstract only).
Huang et al., "Reducing Blueshift of Viewing Angle for Top-Eimtting Organic Light-Emitting Devices," Dec. 6, 2008, 3 pages.
J. Lee, et al. "Cavity Effects on Light Extraction in Organic Light emitting Devices," *Applied Physics Letters*, Jan. 24, 2008, vol. 92, No. 3, 5 pages.
S.H. Kim et al. "Fabrication and Characterization of co-planar type MEMS Structures on SiO2/sI3n4 Membrane for Gas Sensrors with Dispensing Method Guided by Micromachined Wells," Journal of Electroceramicx, 2006, vol. 17, No. 2-4, pp. 995-998.

* cited by examiner

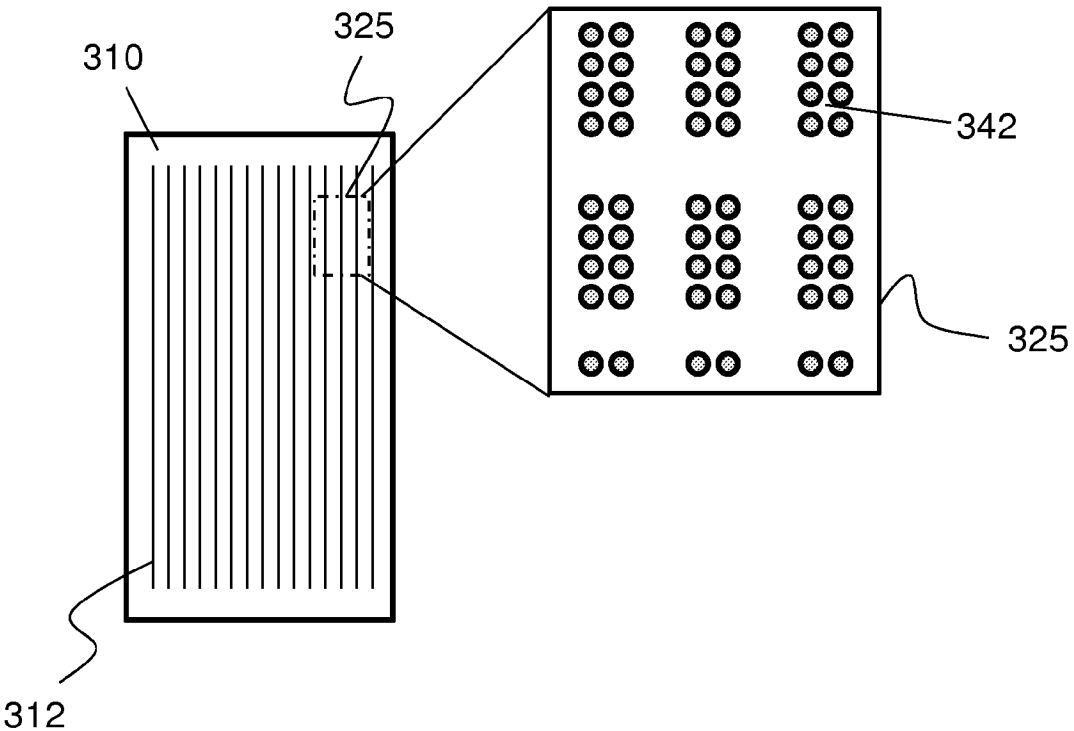
Fig. 3E
Fig. 3D
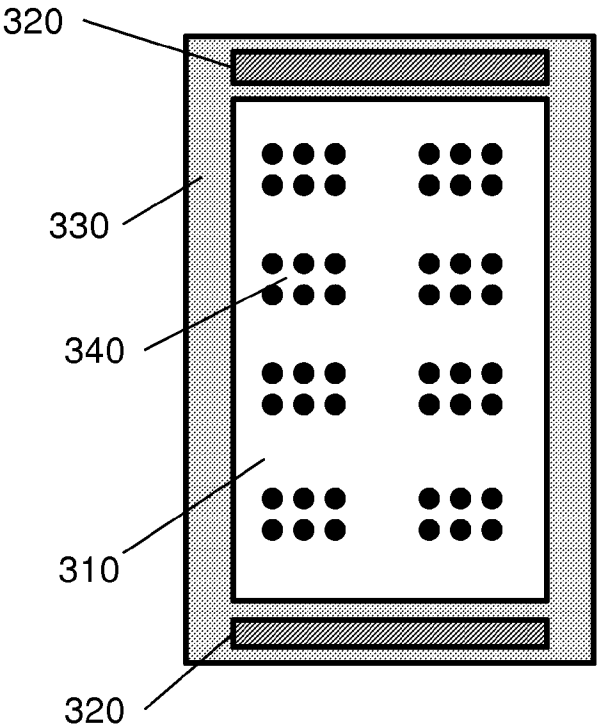
Fig. 3C

METHOD AND APPARATUS FOR PRINTING USING A FACETTED DRUM

CROSS-REFERENCE TO RELATED APPLICATIONS

The instant application claims priority to the Provisional Application No. 61/473,646 filed Apr. 18, 2011. This application is a continuation-in-part of patent application Ser. No. 12/954,910 (filed Nov. 29, 2010) which claims priority to Provisional Application No. 61/283,011 (filed Nov. 27, 2009). This application is a continuation-in-part of application Ser. No. 12/139,404 (filed Jun. 13, 2008), which claims priority to Provisional Application No. 60/944,000 (filed Jun. 14, 2007). The disclosure of each of the identified application is incorporated herein in its entirety.

BACKGROUND

1. Field of the Invention

The disclosure generally relates to a method and apparatus for depositing a substantially solid film onto a substrate. More specifically, the disclosure relates to a novel method for printing an Organic Light-Emitting Diode ("OLED") film using a facetted rotating source or a drum.

2. Description of Related Art

In printing electronic films it is important to deposit a dry film onto a surface so that the material being deposited forms a substantially solid film upon contact with the substrate. This is in contrast with ink printing where wet ink is deposited onto the surface and the ink then dries to form a solid film. Because the inking process deposits a wet film, it is commonly referred to as a wet printing method.

Wet printing methods have two significant disadvantages. First, as ink dries, the solid content of the ink may not be deposited uniformly over the deposited area. That is, as the solvent evaporates, the film uniformity and thickness varies substantially. For applications requiring precise uniformity and film thickness, such variations in uniformity and thickness are not acceptable. Second, the wet ink may interact with the underlying substrate. The interaction is particularly problematic when the underlying substrate is pre-coated with a delicate film. An application, in which both of these problems are critical is the deposition of organic light-emitting diode ("OLED") films.

The problem with wet printing can be partially resolved by using a dry transfer printing technique. In transfer printing techniques in general, the material to be deposited is first coated onto a transfer sheet and then the sheet is brought into contact with the surface onto which the material is to be transferred. This is the principle behind dye sublimation printing, in which dyes are sublimated from a ribbon in contact with the surface onto which the material will be transferred. This is also the principle behind carbon paper. However, the dry printing approach introduces new problems. Because contact is required between the transfer sheet and the target surface, if the target surface is delicate it may be damaged by contact. Furthermore, the transfer may be negatively impacted by the presence of small quantities of particles on either the transfer sheet or the target surface. Such particles will create a region of poor contact that impedes transfer.

The particle problem is especially acute in cases where the transfer region consists of a large area, as is typically employed in the processing of large area electronics such as flat panel televisions. In addition, conventional dry transfer techniques utilize only a portion of the material on the transfer medium, resulting in low material utilization and significant waste. Film material utilization is important when the film material is very expensive. An application where all of these problems are particularly pronounced is, again, the OLED film deposition.

Therefore, there is a need for a method and apparatus to provide, among others, a non-contact, dry technique for depositing an OLED film that overcomes these and other disadvantages and shortcomings.

SUMMARY

In one embodiment, the disclosure relates to a facetted drum for simultaneously printing multiple pixels. The, facetted drum comprises a support structure and a plurality of printheads affixed to the support structure, each printhead having at least one micropore for receiving a first quantity of liquid ink having dissolved or suspended film material in a carrier fluid and dispensing a second quantity of ink material substantially free of the carrier fluid. The plurality of printheads are positioned proximal to a substrate to simultaneously print a plurality of spatially-discrete and image-resolved pixels on the substrate. A spatially-discrete means pixels that are substantially free of overlap and image-resolved defines pixels that are substantially free of bubbles or other infirmities and physical defects. A printhead according to one embodiment of the disclosure comprises an array of micropores and wherein each micropore is spaced apart from an adjacent micropore by about 1-4 μm and wherein at least one micropore is about 3 μm in diameter. The spatially-discrete and image-resolved pixels can be printed on the substrate at about 25-500 pixels per inch.

In another embodiment, the disclosure relates to a facetted drum system for massively parallel pixel printing. The facetted drum comprises a chuck for receiving a rotating printhead assembly; a plurality of facets, each facet tangentially affixed to a respective face of the rotating printhead assembly; and a plurality of printheads positioned on each facet, at least one printhead having an array of micropores for receiving a first quantity of liquid ink having dissolved or suspended film material in a carrier fluid and dispensing a second quantity of ink material substantially free of the carrier fluid. The micropores can comprises one or more groves, channels, vias, thorough holes and blind holes.

In another embodiment, the disclosure relates to a system for printing a film on a substrate, the system comprising: a microprocessor circuit; a memory circuit in communication with the microprocessor circuit, the memory circuit storing instructions for the processor circuit to: (1) supply a quantity of liquid ink to a facet of a drum, the facet having a printhead thereon and the liquid ink defined by a carrier liquid having suspended and/or dissolved ink particles, (2) remove the carrier liquid from the supplied quantity of ink in order to form a substantially liquid-free quantity of ink on the printhead, (3) evaporate the substantially liquid-free quantity of ink remaining on the printhead; and (4) direct the vaporized quantity of ink onto the substrate. In one embodiment of the disclosure, directing the vaporized quantity of ink further includes the step of aligning the printhead with the substrate.

In still another embodiment, the disclosure relates to a method for printing a film from a rotating drum having a plurality of facets, the method comprising: supplying a quantity of liquid ink to one of the plurality of the facets, the facet supporting a microstructure thereon and the liquid ink defining a carrier liquid having suspended and/or dissolved ink particles; removing the carrier liquid from the supplied quantity of ink to form a substantially liquid-free quantity of ink on the printhead, evaporating the substantially liquid-free quantity of ink remaining on the printhead; and dispensing the vaporized quantity of ink from the printhead onto the substrate. The drum can be rotated such that the facet receives liquid ink at a first dimension while dispensing the vaporized ink at a second dimension. In an embodiment of the disclosure only one facet is inked at a time. In another embodiment of the disclosure, a plurality of facets are inked simultaneously.

BRIEF DESCRIPTION OF THE DRAWINGS

These and other embodiments of the disclosure will be discussed with reference to the following exemplary and non-limiting illustrations, in which like elements are numbered similarly, and where:

FIG. 3C illustrates an exemplary support structure having an activating unit and a micro-patterned region according to one embodiment of the disclosure;

FIG. 3D illustrates another exemplary support structure for use with a facetted drum.

FIG. 3E is an exploded view of a portion of the support structure of FIG. 3D;

DETAILED DESCRIPTION

Figure 1:
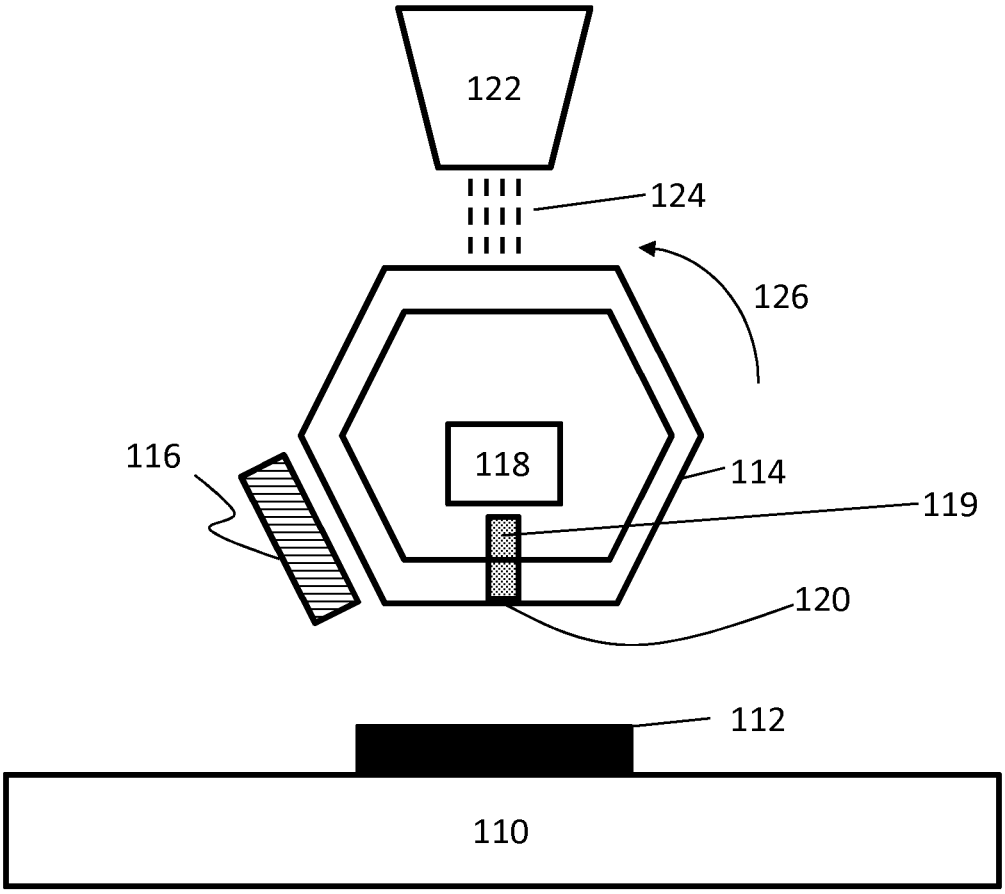
FIG. 1 schematically illustrates a facetted deposition system according to an embodiment of the disclosure.

FIG. 1 schematically illustrates a facetted deposition system according to an embodiment of the disclosure. In FIG. 1, a hexagonal drum-type (interchangeably, facetted drum) deposition system 114 is used to deposit a quantity of film material on substrate 110. Deposition system 114 of FIG. 1 has six separate and independent facets, at least a portion of each of the facet surfaces containing one or more printheads. Each printhead can receive film material 124 from material delivery mechanism 122 in one orientation and deliver the received film material to substrate 110 in another orientation.

The film material can be delivered to the printheads in the form of a solid ink, liquid ink, or gaseous vapor ink consisting of pure film material or film material and non-film (interchangeably, carrier) material. Using ink can be helpful because it can provide the film material to the printhead with one or more non-film materials to facilitate handling of the film material prior to deposition onto the substrate. The film material can consist of OLED material. The film material can comprise a mixture of multiple materials. The carrier material can also comprise of a mixture of multiple materials.

An example of a liquid ink is film material dissolved or suspended in a carrier fluid. Another example of a liquid ink is pure film material in the liquid phase, such as film material that is liquid at the ambient system temperature or film material that is maintained at an elevated temperature so that the film material forms a liquid melt. An example of a solid ink is solid particles of film material. Another example of a solid ink is film material dispersed in a carrier solid. An example of a gas vapor ink is vaporized film material. Another example of a gaseous vapor ink is vaporized film material dispersed in a carrier gas. The ink can deposit on the printhead as a liquid or a solid, and such phase can be the same or different than the phase of the ink during delivery. In one example, the film material can be delivered as gaseous vapor ink and deposit on the printhead in the solid phase. In another example, the film material can be delivered as a liquid ink and deposit on the printhead in the liquid phase. The ink can deposit on the printhead in such a way that only the film material deposits and the carrier material does not deposit. The ink can also deposit in such a way that the film material as well as one or more of the carrier materials deposits.

In one example, the film material can be delivered as a gaseous vapor ink comprising both vaporized film material and a carrier gas, and only the film material deposits on the printhead. In another example, the film material can be delivered as a liquid ink comprising film material and a carrier fluid, and both the film material and the carrier fluid deposit on the printhead. In still another embodiment, the film material is delivered as a liquid and the carrier fluid volatilizes or flashes upon contact with the printhead, thereby leaving only ink material on the printhead. The film material delivery mechanism can further deliver the film material onto the printhead in a prescribed pattern. The delivery of film material to the substrate can be performed with material contact or without material contact between the printhead and the substrate. The film material can be gravity fed to the printhead(s) or can be injected using conventional ink delivery systems.

Referring again to FIG. 1, the metered film material 124 is directed to rotating facetted drum 114. The film material can be directed to rotating drum 114 through gravity feed. Alternatively, a directed film material delivery system can be to target the metered film material 124 onto a specified portion of rotating drum 114. In one example, the film material delivery mechanism 122 is an inkjet printhead delivering droplets of liquid ink 124 onto the drum 114.

In the embodiment of FIG. 1, rotating drum 114 has flat surfaces which receive a driver board (not shown) having thereon a solid state support (not shown) and one or more printheads (not shown). A solid state support can define a solid surface with integrated parts. Each facet of the drum can receive at least one or more driver board assembly. The printheads can function to receive, in a first orientation, the metered film material 124 and then transfer it in a second orientation onto substrate 110. Metered film material 124 received on the surface of rotating drum 114 in the first orientation is moved towards substrate 110 and into the second configuration by the rotation of the drum as shown by arrow 126. Rotating drum 114 may have a single transfer surface defining a continuous belt-type surface at the periphery of drum 114 or it can define a number of discrete, independent or discontiguous surfaces.

Film material 124 may be delivered onto the printheads in a first prescribed pattern. In either the first, second, or other intermediate orientations (or planes), film material 124 may be organized on the micropores (not shown) of each printhead. In the second orientation (or, second plane), the film material 124 is transferred onto substrate 110, and the film material may deposit on the substrate and assume the orientation consistent with the micropores (not shown). Thus, in one embodiment, the ink material is received at the facetted drum at a first plane and deposited onto the substrate a second plane. In an alternative embodiment, the ink material can be received at the substrate at a first plane and deposited onto the substrate at a second plane.

As stated, each printhead can further contain micro-patterned features, such as micropores, micro-channels, micro-pillars, or other micro- or nano-patterned structures, and may further include arrays of such structures (interchangeably, micro-arrays). The micro-patterned structure can organize the film material by maintaining a pattern as delivered by the delivery mechanism. It can also organize the film material by rearranging the film material into a new pattern. Thus, micro-patterning can be used to organize the film material by both maintaining a pattern and/or changing the pattern of material in order to achieve a desired pattern. The micro-patterning can assist in organizing the metered film material 124 once received on the transfer surface and/or the printhead. Such organization may be carried out by means of capillary or other forces acting between the micro-patterned structure and the material deposited on the transfer surfaces or the printheads. When the thermal dispensing jet is the drum and where the transfer surface itself has a micro-patterned structure (such as micro-patterned structured formed on the drum itself), such micro-patterned structure may assist in the organization of film material 124 on the transfer surface, and following such organization film material 124 may be substantially on regions with micro-patterned structures, substantially on regions without the micro-patterned structures, or substantially on both such regions. For example, a plurality of channels or grooves can be formed on the surface of the drum such that the channels receive the ink material and deposit the ink material onto the substrate, thereby forming a print impression having a substantially identical pattern as the channels or the grooves.

Optional conditioning unit 116 is positioned near the outer surface of rotating drum 114. Conditioning unit 116 may also be positioned inside the drum. Conditioning unit 116 can transmit radiation, convection or conduction heating or introduce directed gas flows to condition the metered film material prior to transferring the film material from the printheads to substrate 110. In one embodiment, the metered film material 124 comprises a quantity of liquid ink comprising film material and a carrier fluid and conditioning unit 116 functions as a drying unit to substantially evaporate the carrier fluid to form a substantially dry layer of film material on the printheads of rotating drum 114.

Optical source 118 and optical pathway 119 can be optionally added and configured to energize region 120 on the transfer surface. Region 120 can be a printhead or a support surface having multiple printheads thereon. Region 120 contains the film material 124, each facetted surface having previously received the film material 124 in the first configuration and now rotated into the second configuration. By energizing the printheads, transfer of the film material from the facetted surface onto the substrate is carried out and film 112 is formed.

In one embodiment of the disclosure, optical light source 118 is a laser source in communication with an optical train (lenses, filters, etc.) allowing the energy to be focused on one or more discrete regions of rotating drum 114. Optical light source 118 can energize region 120 of the facetted surface (or exclusively the printheads) thermally or through radiation heating. In an exemplary embodiment, an infrared radiation ("IR") source can be used for this purpose. The application of optical light source 118 is optional and other means for energizing the facetted surface to effect the transfer of the film material onto the deposition surface are well within the scope of the disclosure. In one embodiment, the transfer surface and/or the printhead contains an integrated heater (not shown), such as a resistive heater, and the activation of this heater effects transfer of the film material onto the substrate, for example, by thermally evaporating the film material. In another embodiment, the printheads contain an integrated piezoelectric material (not shown) that can be activated to assist the transfer of the film material onto the deposition surface, for example by agitating and thereby dislodging the film material from the printheads. In yet another embodiment, an external mechanism is provided to direct vibration or pressure waves onto the printheads to assist the transfer of the film material onto the deposition surface, for example by agitating and thereby dislodging the film material from the printhead.

Figure 2:
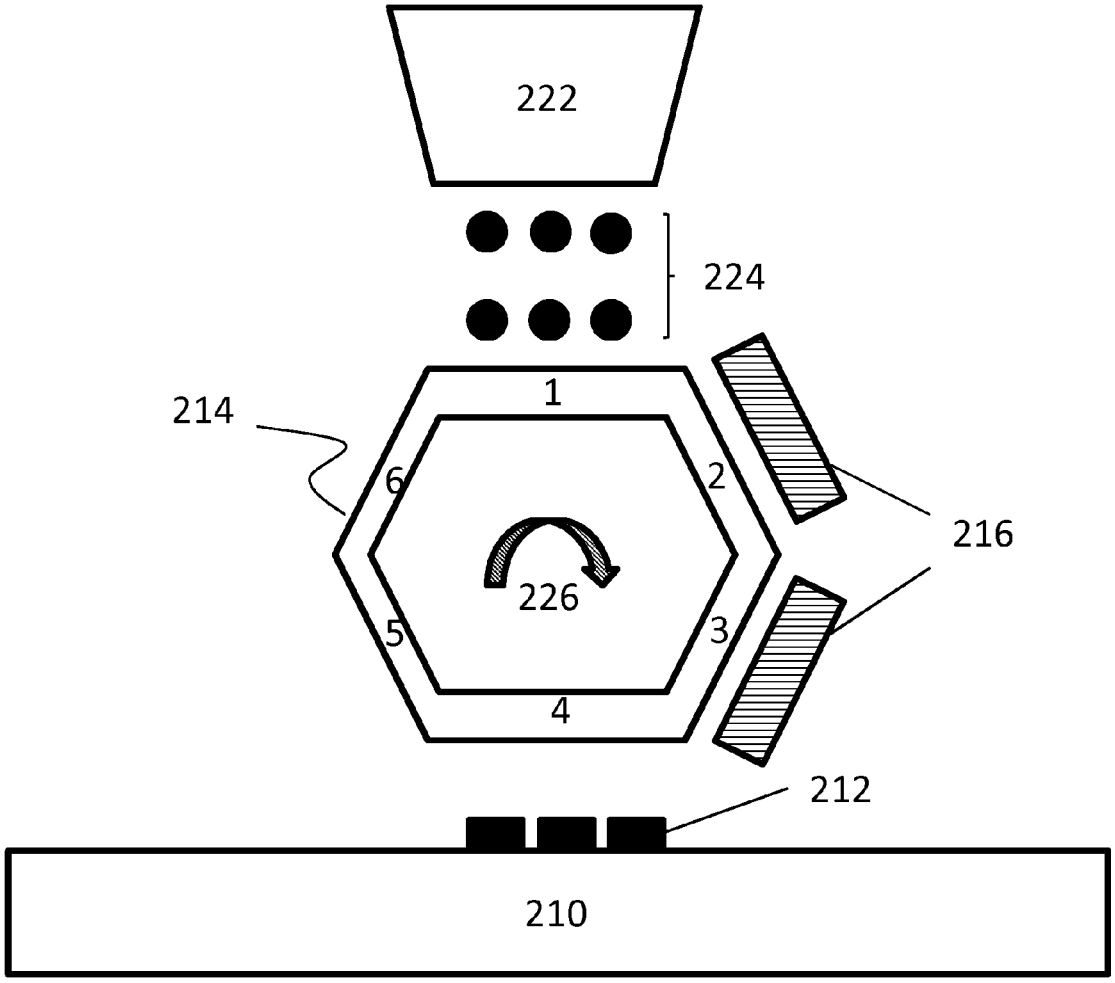
FIG. 2 is a schematic illustration of a rotating, facetted deposition system according to one embodiment of the disclosure.

FIG. 2 is another schematic illustration of a rotating, facetted, deposition system according to an embodiment of the disclosure. In FIG. 2, facetted drum 214 has six discrete surfaces which are numbered as surfaces 1 through 6. Each surface (or facet) can receive a structure with one or more printheads. In one exemplary embodiment, each facet may contains a driver board (not shown) having thereon a support structure (not shown) for receiving a plurality of printheads (not shown). As will be discussed, the support structure may receive one or more printheads, the support structure providing means for: (1) removably mounting one or more discrete printheads thereon, (2) mounting the combination of one or more printheads onto a facet as a single unit, and (3) providing electrical communication between a control circuit and the printheads. As will be discussed, each printhead may contain one or more micro-patterned regions arranged to organize the film material on the printhead in a prescribed pattern to form a particular pattern of deposited film material on the deposition surface. The printheads receive metered film material 224, which can comprise a liquid ink containing dissolved or suspended film material in a carrier fluid.

The rotation direction of facetted drum 214 is shown by arrow 226. Film material delivery mechanism 222 meters film material 224 to the one or more transfer printheads on facet 1 of the facetted drum 214. In one embodiment, film material delivery mechanism 222 comprises an inkjet printhead for metering film material in the form of a liquid ink. As facetted drum 214 rotates along the direction of arrow 226, one or more printheads on facet 1 pass by optional conditioning units 216. Optional conditioning units 216 may comprises heaters, and in an embodiment where the metered film material comprises a liquid ink, heaters 216 can assist in evaporating the carrier fluid from the one or more printheads on facet 1, such that the film material forms a dry deposit on each printhead prior to deposition. In general, the one or more printheads may have a micro-patterned structures for organizing the film material.

As facet 1 reaches substrate 210, the film material on its one or more printheads will be substantially free of carrier liquid. The substantially liquid free film material is then transferred from the one or more printheads on facet 1 to substrate 210 without material contact between the one or more printheads and substrate 210.

The transfer of film material from a facet to the substrate can be through diffusion which may be supplemented with an external energy source. For example, the one or more printheads on facet 1 can be equipped with actuators that can dislodge the film material from the printheads and transfer the film material onto the deposition surface. The printheads on facet 1 can alternatively be equipped with thermal actuators that can deliver thermal energy to the film material and thereby transfer the film material onto the deposition surface, for example, by thermally evaporating or vaporizing the film material. The system of FIG. 2 can also be equipped with an optical device (such as those discussed in relation to FIG. 1) to assist in transferring the film material from the printheads to substrate 210. In one embodiment, when the ink material is on the printhead, the printhead is heated up above the evaporation temperature of the ink material. Once the ink material is in vapor phase, it diffuses (or flashes) into the substrate. The closer the printhead to the substrate, the more confined is the pattern that prints on the substrate.

The film material deposits on substrate 210 in substantially solid phase to form film 212. The shape (and topography) of film 212 is determined in part by the location and arrangement of the film material on the printheads prior to transfer to the substrate, which itself is determined by the spatial pattern utilized by the film delivery mechanism when metering out film material onto the printheads. The arrangement of the film material on the transfer surface can be further determined in part by the presence of a micro-patterned structure (not shown) on the transfer surface. In FIG. 2, film material is arranged on the one or more printheads on facet 1 so as to provide three discrete and discontiguous regions of deposited film material on the substrate. Thus, film 212 reflects these three discrete and discontiguous regions.

The system of FIG. 2 may also include a controller (not shown) for monitoring and controlling the deposition process. The controller can include a processor circuit (not shown) in communication with a memory circuit (not shown), the film delivery mechanism (not shown) and one or more actuators (not shown). The processor circuit can comprise one or more microprocessors. The memory circuit contains instructions which are communicated to the controller circuit and the actuator to, for example, (i) position one or more printheads on a first facet adjacent or proximal to the film material delivery mechanism; (ii) meter a quantity of film material onto the one or more printheads on a first facet; (iii) heat the transfer surface(s) on a first facet to condition the film material, for example, to substantially evaporate the carried fluid if the metered film material is liquid ink; (iv) position the printheads proximal to the substrate to transfer the film material from the printheads onto the substrate; (v) heat the printheads on a first facet to transfer the film material onto the substrate, for example, by thermally evaporating or vaporizing the film material; and (vi) repeat the process with one or more printheads on a second facet.

Figure 3B:
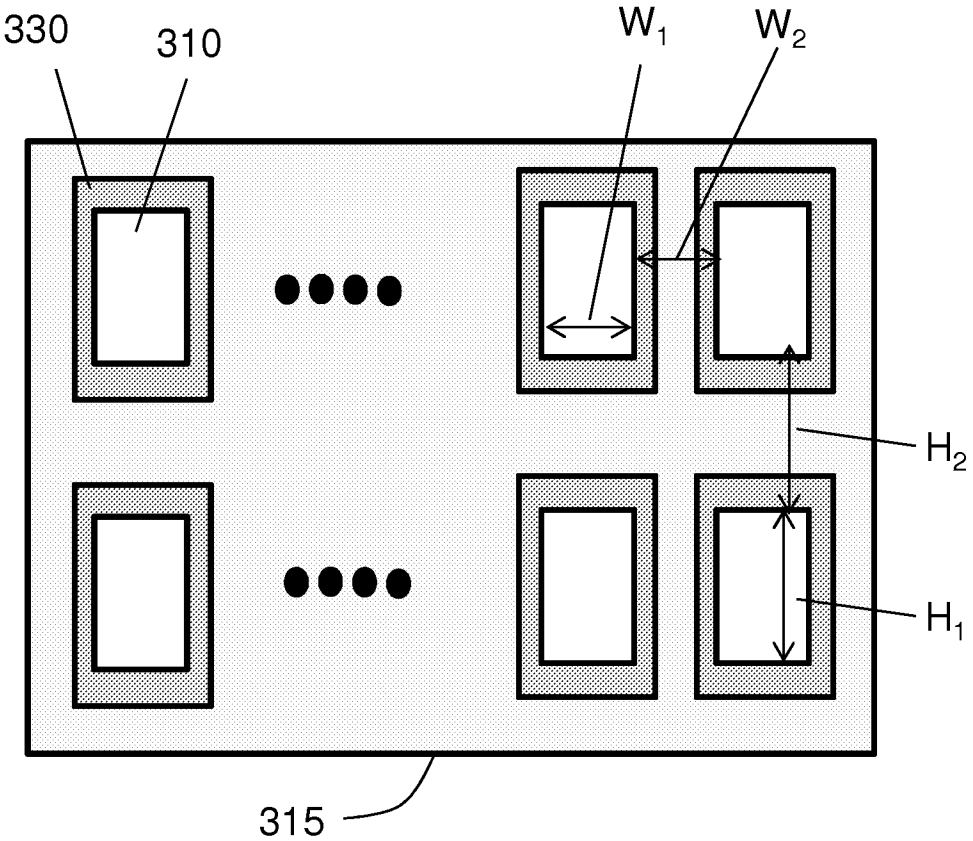
FIG. 3B is an exemplary illustration of a support structure with several printheads.
Figure 3A:
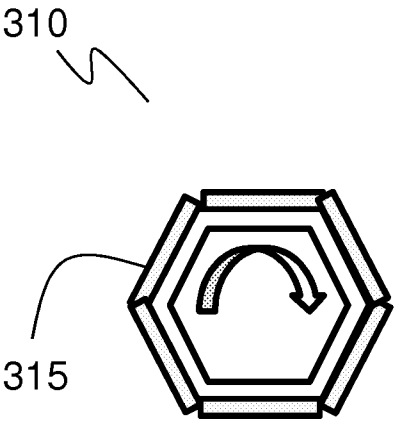
FIG. 3A shows an exemplary hexagonal rotating drum deposition system according to an embodiment of the disclosure.

FIG. 3A shows an exemplary hexagonal rotating drum deposition system according to an embodiment of the disclosure. Specifically, FIG. 3A shows a rotating, facetted component of a deposition system 310 having facet 315 on each of the facets for mounting together one or more discrete, substantially co-planar printheads in the form of transfer surface units, according to an embodiment of the disclosure. Alternatively, a baseplate can be interposed between each facet (with printheads thereon) and each plane of the drum. A facet can be considered as a transfer surface unit. Each face of the hexagonal drum 310 has a facet 315 for mounting one or more transfer surface units. Each support structure can be coupled to a respective facet of drum 310.

FIG. 3B is an exemplary illustration of a support structure with several printheads. Specifically, FIG. 3B shows an exemplary facet 315 having six transfer surface units mounted together in a co-planar surface. Facet 315 is shown to receive a plurality of printheads 330 with each printhead having micropore structures which are schematically shown as regions 310. The printheads 330 can have identical micropore structures or different ones.

Dimensions $W_1$ and $H_1$ define respectively the width and height of the transfer surface on each of the substantially identical transfer surface units. Dimensions $W_2$ and $H_2$ define, respectively, the width and height separation distances between the transfer surfaces as a result of the mounting of the transfer units on the facet 315. In one embodiment, $W_1$ is equal to $W_2$ and $H_1$ is equal to $H_2$. In another embodiment, $W_2$ is equal to an integer multiple of $W_1$ other than one. In yet another embodiment, $H_2$ is equal to an integer multiple of $H_1$ other than one.

FIG. 3C illustrates an exemplary support structure having an activating unit and a micro-patterned region according to one embodiment of the disclosure. The support structure of FIG. 3C, includes transfer surface 310, activating elements 320 (which may be integrated with the unit), support structure 330 and micro-patterned surface structures 340. Activating elements 320 can comprise heating elements, for example, resistive heating elements that can be used to heat the transfer surface to condition the film material for transfer and/or to transfer the film material onto the substrate. Activating elements 320 may also comprise piezoelectric element(s) that can be used for transferring the film material onto the substrate. In an exemplary embodiment, a printhead includes at least 6,000 micropore thereon. In another embodiment, the printhead comprises 2,000-12,000 micropores.

FIG. 3D illustrates another exemplary support structure for use with a facetted drum. In FIG. 3D, transfer surface 310 has lines 312 thereon. Lines 312 schematically illustrate patterns of microstructures formed on surface 310. FIG. 3E is an exploded view of region 325 of the rotating drum surface of FIG. 3D. In FIG. 3E, the micro-patterned region 325 comprises micropore arrays 342 arranged in rows and columns. This exemplary embodiment shows the micropores organized into three columns each having a repeating vertical pattern of micropore pairs. A grouping of micropores arrays 342 define a pixel. An exemplary implementation can have anywhere from 2,000 to 12,000 pixels. Micropores arrays 342 can be micro-machined into the surface of a rotating drum to provide the transfer surface of the drum. In another embodiment, the micro-patterned regions are formed as separate transfer surface units and are then attached or adhered either directly to or through intermediate baseplates and/or packages to an underlying rotating or conveying mechanism.

Figure 4:
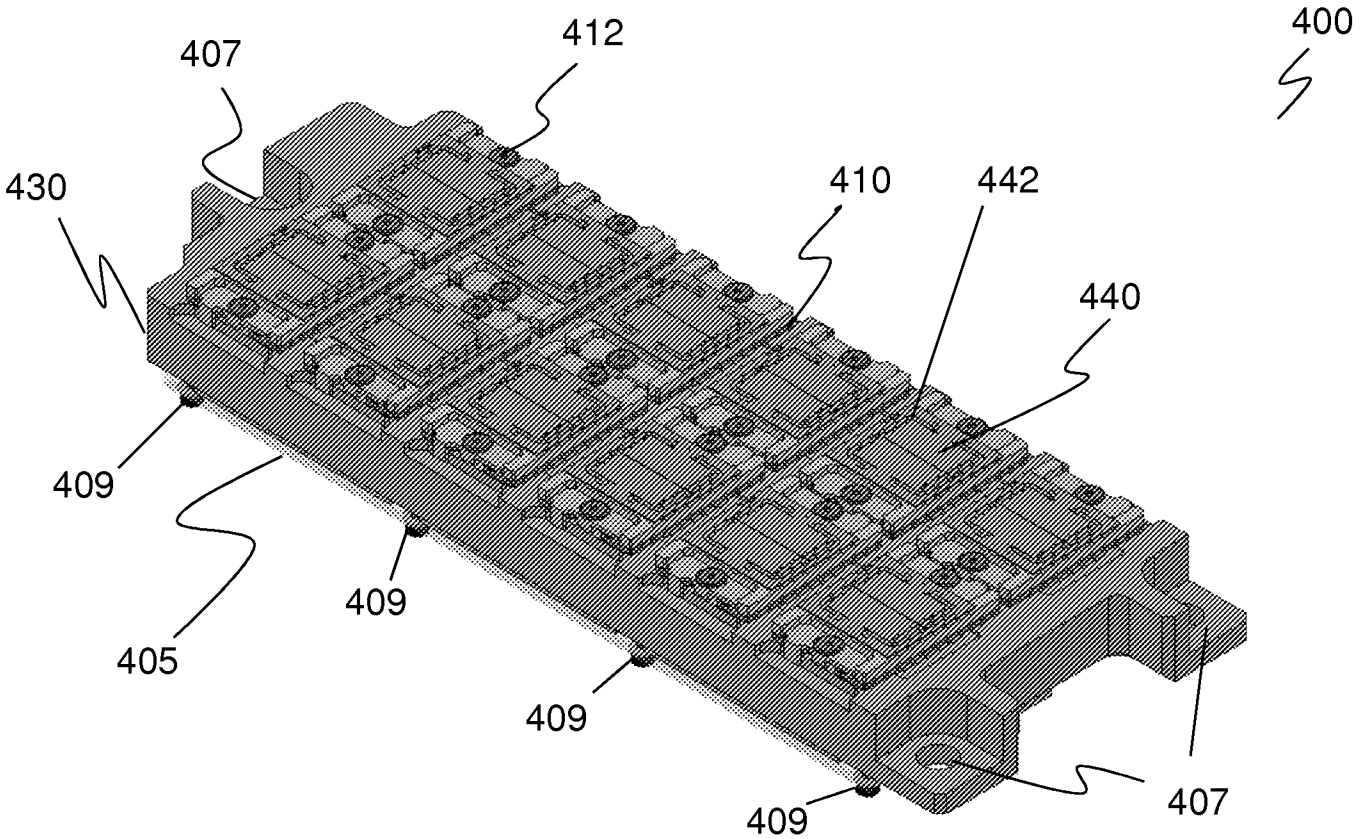
FIG. 4 schematically shows a facetted support structure according to one embodiment of the disclosure.

FIG. 4 shows a facet support structure according to one embodiment of the disclosure. Support structure 400 includes circuit board driver 405 at the distal end thereof. Circuit board 405 may include a processor circuit configured to communicate electromechanical instructions to printheads 440. Circuit board 405 may also include pins and I/O connections allowing it to communicate with a global controller which directs printing from other facets of the drum or from facets of multiple drums.

Support structure 430 is coupled to circuit board 405 though a plurality of fasteners 409. While the embodiment of FIG. 4 shows coupling through fasteners 409, the circuit board and the support structure can be connected in any known manner. In an exemplary embodiment, support structure 430 can be a solid state structure formed from a silicon or similar composites. While not shown in FIG. 4, support structure 430 can have one or more flanges along with internally formed channels for communicating a fluid from an external source (not shown) to transfer surface 410. As will be discussed below, the communicated fluid may include air or a pressurized gas calculated to assist in the printing process.

A plurality of printheads 440 are arranged on the surface of support structure 430 and are coupled thereto via bolts 412. Bolts 412 enable quick removal and exchange of printheads 430. Each printhead 430 is also shown with integrated heaters 442. Heaters 442 enclose the region of the printhead which contains the microporous structures. Heaters 442 communicate with circuit board 405. The circuit can control timing and the amplitude of power supplied to the heater. Circuit board 405 controls the frequency and the amplitude of the heat generated from heaters 442.

In an embodiment of the disclosure, where liquid ink is deposited over the proximal surface of support structure 430, the deposited ink finds its way to exposed surfaces including printheads (and the micropores formed thereon) as well as transfer surfaces 440. To address the ink away from the transfer surfaces and onto the printing surfaces, an air knife can be used to drive the received ink into the micropores. In addition, the surfaces of the transfer surfaces and the printheads can be machined or formed from different material so that the non-printing surfaces would repel liquid ink material while the printing surfaces (i.e., the microporous structures on the surface of printheads 440) would attract liquid ink.

Figure 5:
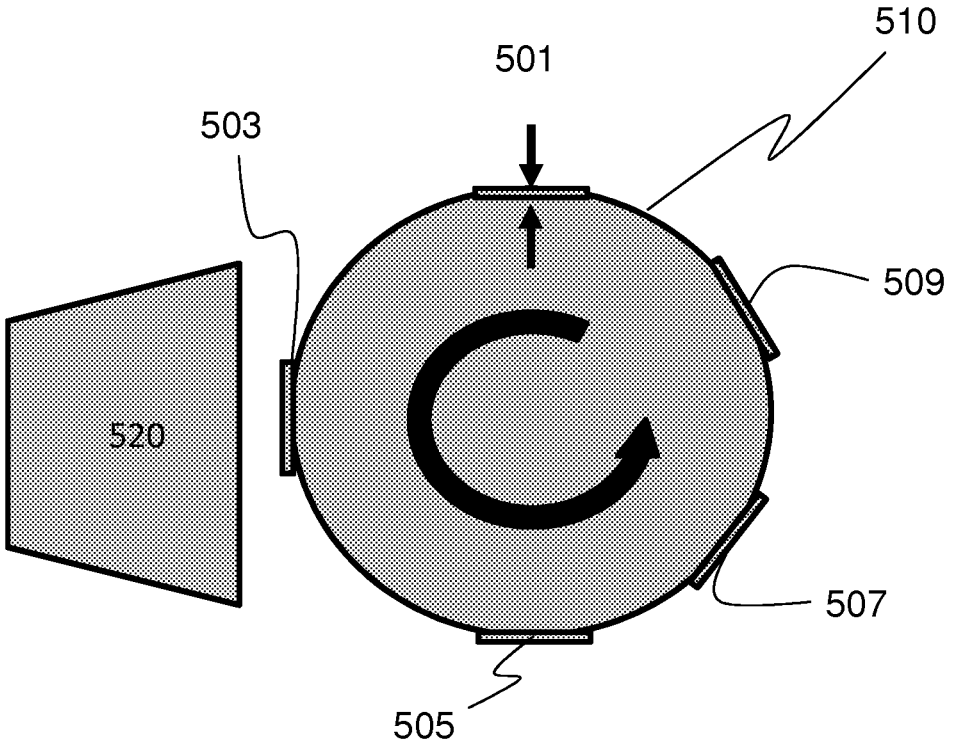
FIG. 5 schematically shows the operation of the facetted drum according to one embodiment of the disclosure.

FIG. 5 schematically shows the operation of the facetted drum according to one embodiment of the disclosure. The process start at stage 501 where a facet having printheads thereon is supplied with ink material. The ink material can define a liquid carrier containing dissolved or suspended ink particles. The ink can be delivered with an ink delivery mechanism. Rotating drum 510 turns counter-clock-wise as indicated by the arrow and at stage 520, the inked facet nears solvent evacuation 520 (the solvent purge port). The solvent evacuation device can be a heating station or a vacuum-type device for removing solvent from the facetted surface. At stage 503 substantially all of the carried fluid is removed from the quantity of ink delivered to the facet. After stage 503, the ink material remaining on the printheads of the facet are substantially free from the carrier liquid and may be in solid phase.

At stage 505, the inked facet is positioned adjacent to the substrate (not shown). Here, the printing step takes place by evaporating the substantially solid ink particles to form a vapor. The vapor then condenses on the substrate to form a coated film. While not shown in FIG. 5, pressurized gas can be injected at the substrate to assist in localized formation of the printed material on the substrate.

At stage 507, the facet (and the printheads) can be cleaned by a cleaning station. The cleaning station may comprise one or more cleaning solutions that are directed to the facet of the drum in order to remove residual ink material therefrom. In an alternative embodiment, the cleaning station comprises one or more heaters for heating the facet surface to vaporize any residual ink material from the drum facet or the printheads thereon. At stage 509, each facet and its respective printheads are cooled and prepared for another cycle of deposition. It should be noted that with a drum having multiple coating facets, the printing step can be continuously carried out with a different facet. For example, when one facet is printing, an adjacent facet may be getting cleaned or receiving ink.

Controlling the stages shown in FIG. 5 can be implemented with a controller. The controller may comprise one or more microprocessor circuits coupled to one or more memory circuits. The memory circuit may communicate instructions to the processor circuit to: (1) arrange for inking of a facet of the rotating drum (including, but not limited to, supplying a predetermined quantity of ink to each facet or to each printhead), (2) removing the carrier liquid from the predetermine quantity of ink in order to provide a substantially liquid-free quantity of ink, (3) dispersing the liquid-free quantity of ink from the printheads and onto a substrate, (4) cleaning the facet after the deposition step, and (5) cooling and/or preparing the facet prior to repeating these steps. The controller may globally control a plurality of printheads. Alternatively, each drum or each facet can have its own controller.

Figure 6:
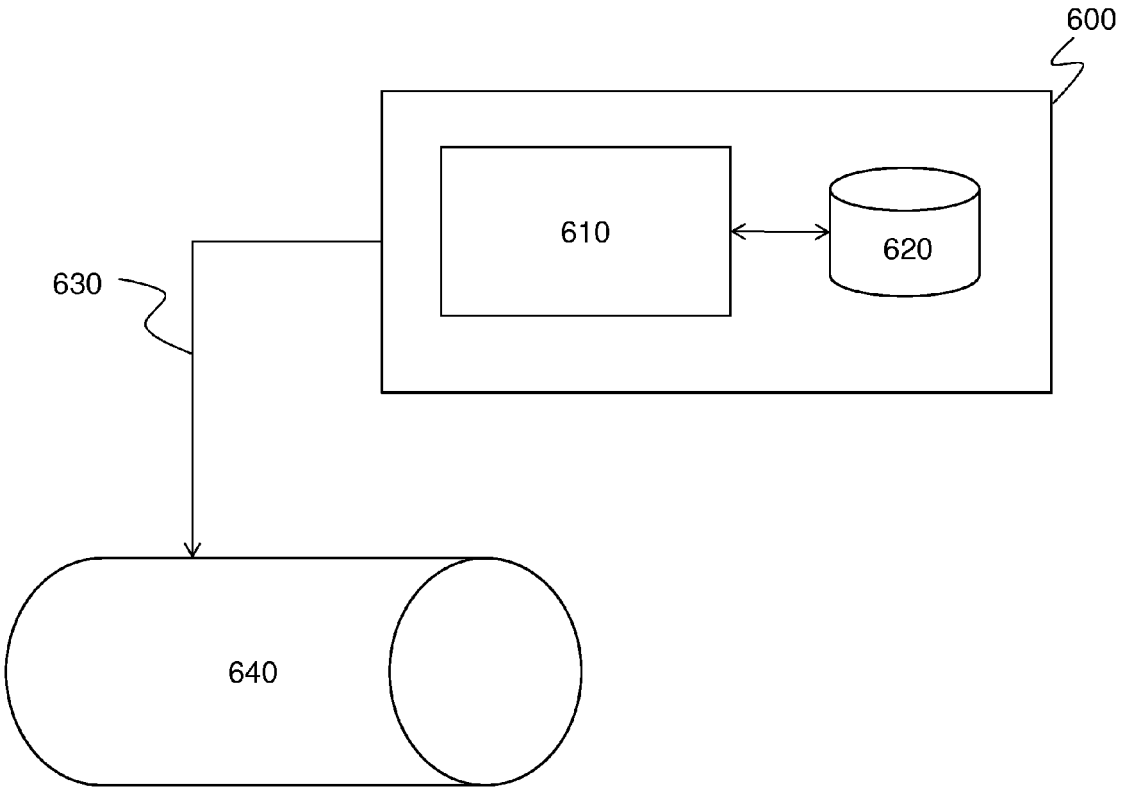
FIG. 6 is a schematic representation of a system according to one embodiment of the disclosure.

FIG. 6 is a schematic representation of a control system for the printing apparatus discussed herein. Controller 600 comprises microprocessor circuit 610 connected to database 620. Database 620 can communicate with the operator through an I/O system (not shown) wherein the operator can communicate the appropriate print, heating, cleaning, etc. settings. Controller 600 communicates with drum printer 640 through medium 630. Drum 640 can be a facetted drum supporting multiple printheads (not shown) as discussed above. Each facet may comprise a driver circuit board (not shown) for controlling the printing operation at the respective printheads.

While the principles of the disclosure have been illustrated in relation to the exemplary embodiments shown herein, the principles of the disclosure are not limited thereto and include any modification, variation or permutation thereof.

What is claimed is:

1. A facet structure for printing multiple pixels, comprising:

a support structure;

a plurality of printheads affixed to the support structure, each printhead having at least one micropore for receiving a first quantity of liquid ink having dissolved or suspended film material in a carrier fluid and dispensing a second quantity of ink material substantially free of the carrier fluid;

wherein the plurality of printheads are positioned proximal to a substrate to simultaneously print a plurality of spatially-discrete and image-resolved pixels on the substrate at about 25-500 pixels per inch.

2. The facetted structure of claim 1, further comprising a flange for receiving a fluid at the support structure.

3. The facetted structure of claim 1, further comprising a driver board coupled to the support structure, the driver board having a processor for actuating ink dispensing from at least one printhead.

4. The facetted structure of claim 1, wherein at least one micropore is a closed micropore.

5. The facetted structure of claim 1, wherein at least one micropore is an open micropore extending through the printhead.

6. The facetted structure of claim 1, wherein at least one printhead of the plurality of printheads comprises an array of micropores and wherein each micropore is spaced apart from an adjacent micropore by about 1-4 μm.

7. The facetted structure of claim 1, wherein at least one micropore is about 3 μm.

8. A facetted drum system for pixel printing, comprising:

a chuck for receiving a rotating printhead assembly;

a plurality of facets, each facet tangentially affixed to a respective face of the rotating printhead assembly; and a plurality of printheads, wherein at least one printhead is mounted to each facet; said at least one printhead having an array of micropores to receive a first quantity of liquid ink; said liquid ink comprised of dissolved or suspended film material in a carrier fluid and to dispense a second quantity of ink material substantially free of the carrier fluid;

wherein the at least one printhead mounted to each facet can be rotatably positioned proximal to a substrate to simultaneously print a plurality of spatially-resolved pixels.

9. The facetted drum system of claim 8, wherein each facet comprises a facet driver board, a support structure and the plurality of printheads.

10. The facetted drum system of claim 8, wherein the support structure further comprises at least one channel for communicating a fluid to the substrate.

11. The facetted drum system of claim 10, wherein the fluid defines a gas.

12. The facetted drum system of claim 8, further comprising an ink delivery structure for communicating liquid ink to each facet.

13. The facetted drum system of claim 8, further comprising a cleaning station for cleaning each facet after printing.

14. The facetted drum system of claim 8, wherein each printhead further comprises an actuator for dispensing the second quantity of ink material.

15. The facetted drum system of claim 8, wherein each printhead further comprises a heater for dispensing the second quantity of ink material.

16. The facetted drum system of claim 8, further comprising a controller for dictating the rotation of the rotating printhead assembly for receiving a first quantity of liquid ink and for dispensing the second quantity of ink material.

17. The facetted drum system of claim 8, wherein at least one micropore is a closed micropore.

18. The facetted drum system of claim 8, wherein at least one micropore is an open micropore extending through the printhead.

19. The facetted drum system of claim 8, wherein the printheads are arranged to dispense ink to thereby print spatially-discrete and image-resolved pixels on a substrate.

20. A system for printing a film on a substrate, the system comprising:

a microprocessor circuit;

a memory circuit in communication with the microprocessor circuit, the memory circuit storing instructions for the processor circuit to:

(1) meter a quantity of liquid ink to a facet of a drum; the facet having at least one printhead thereon, wherein the quantity of liquid ink is supplied to the facet from an external ink delivery source;

(2) remove the carrier liquid from the supplied quantity of ink in order to form a substantially liquid-free quantity of ink on the at least one printhead, (3) evaporate the substantially liquid-free quantity of ink remaining on the at least one printhead; and (4) direct the vaporized quantity of ink onto the substrate to simultaneously print a plurality of spatially-discrete and image-resolved pixels on the substrate.

21. The system of claim 20, further comprising heating the printhead to remove the carrier liquid.

22. The system of claim 20, wherein the step of metering a quantity of liquid ink further comprises directing an external ink delivery source to meter the quantity of liquid ink onto the printhead.

23. The system of claim 20, wherein the step of metering a quantity of liquid ink further comprises using an air-knife to force the quantity of liquid ink into the printhead.

24. The system of claim 20, wherein the step of removing the carrier liquid from the supplied quantity of ink further comprises heating at least one of the facet or the printhead to a temperature to evaporate the carrier fluid.

25. A method for printing a film from a rotating drum having a plurality of facets, the method comprising:

supplying a quantity of liquid ink to one of the plurality of the facets, the facet supporting a microstructure thereon and the liquid ink defining a carrier liquid having suspended and/or dissolved ink particles;

removing the carrier liquid from the supplied quantity of ink to form a substantially liquid-free quantity of ink on the printhead, evaporating the substantially liquid-free quantity of ink remaining on the printhead; and dispensing the vaporized quantity of ink from the printhead onto the substrate;

wherein the drum is rotated such that the facet receives liquid ink at a first orientation while dispensing the vaporized ink at a second orientation.

26. The method of claim 25, further comprising heating the microstructure to remove the carrier liquid.

27. The method of claim 25, wherein the step of supplying a quantity of liquid ink further comprises directing an external ink delivery source to meter the first quantity of liquid ink onto the facet.

28. The method of claim 25, wherein the step of supplying a quantity of liquid ink further comprises directing an external ink delivery source to meter the first quantity of liquid ink onto the microstructure.

29. The method of claim 25, wherein the step of supplying a quantity of liquid ink further comprises using an air-knife to force the supplied quantity of liquid ink into the microstructure.

30. The method of claim 25, wherein the step of removing the carrier liquid from the supplied quantity of ink, further comprises heating at least one of the facet or the microstructure to a temperature to evaporate the carrier fluid.

31. The method of claim 25, wherein the step of directing the vaporized quantity of ink onto the substrate further comprises using an auxiliary flow to direct the vaporized ink onto the substrate.

* * * * *